US008439655B2

(12) United States Patent
Pouysegur

(10) Patent No.: US 8,439,655 B2
(45) Date of Patent: May 14, 2013

(54) COOLING CHANNEL FOR A FAN MOTOR FOR A VENTILATION, HEATING, AND/OR AIR CONDITIONING SYSTEM

(75) Inventor: Serge Pouysegur, Le Perray en Yvelines (FR)

(73) Assignee: Valeo Systemes Thermiques S.A.S., Le Mesnil, Saint Denis (FR)

( * ) Notice: Subject to any disclaimer, the term of this patent is extended or adjusted under 35 U.S.C. 154(b) by 1239 days.

(21) Appl. No.: 11/732,527

(22) Filed: Apr. 4, 2007

(65) Prior Publication Data

US 2007/0237626 A1 Oct. 11, 2007

(30) Foreign Application Priority Data

Apr. 10, 2006 (FR) ..... 06 03159

(51) Int. Cl.
*F04B 39/02* (2006.01)

(52) U.S. Cl.
USPC ..... 417/366; 417/369; 417/370; 417/371; 415/206; 415/169.1

(58) Field of Classification Search ..... 417/366, 417/369, 370, 371; 415/206, 169.1
See application file for complete search history.

(56) References Cited

U.S. PATENT DOCUMENTS

| | | | | |
|---|---|---|---|---|
| 2,289,474 | A | | 7/1942 | Anderson |
| 2,373,969 | A | | 3/1943 | Lincoln |
| 3,796,511 | A | | 3/1974 | Hansen |
| 6,034,451 | A | * | 3/2000 | El Mayas ..... 310/63 |
| 6,802,699 | B2 | * | 10/2004 | Mikami et al. ..... 417/369 |
| 7,011,506 | B2 | * | 3/2006 | Kim ..... 417/366 |
| 7,699,587 | B2 | * | 4/2010 | Chapman et al. ..... 417/370 |

FOREIGN PATENT DOCUMENTS

| | | | | |
|---|---|---|---|---|
| FR | 693 674 | A | | 11/1930 |
| FR | 2 819 296 | A | | 7/2002 |
| GB | 399 365 | A | | 10/1933 |
| JP | 61175115 | A | * | 8/1986 |
| JP | 11235921 | A | * | 8/1999 |
| JP | 2001342998 | A | * | 12/2001 |

* cited by examiner

*Primary Examiner* — Charles Freay
*Assistant Examiner* — Christopher Bobish
(74) *Attorney, Agent, or Firm* — Howard & Howard Attorneys PLLC

(57) ABSTRACT

Ventilating device (1) comprising a casing (6) intended to channel at least one air flow (3) created by a blower wheel (5), the said casing (6) delimites a main air channel (7) in which a main air flow (3*a*) circulates and a secondary air channel (8) intended to bring towards a motor (4) a secondary air flow (3*b*) in order to cool the motor (4), the said secondary air channel (8) comprising a inlet (11) arranged in a main channel wall (7*c*) and a outlet arranged in a plan containing a casing end by which the wheel (5) is introduced, the said secondary channel (8) further comprising a means intended to change at least twice the direction of the secondary air flow (3*b*) when the secondary air flow (3*b*) passes through the secondary air channel (8).

20 Claims, 6 Drawing Sheets

COOLING CHANNEL FOR A FAN MOTOR FOR A VENTILATION, HEATING, AND/OR AIR CONDITIONING SYSTEM

TECHNICAL FIELD OF THE INVENTION

The present invention relates to a ventilation device that creates an air flow for supplying an air conditioning and/or heating system. The present invention makes it possible to cool an electric motor by means of an air flow. The present invention relates more particularly to a ventilation device for a motor vehicle.

BACKGROUND OF THE INVENTION

Figure 1:
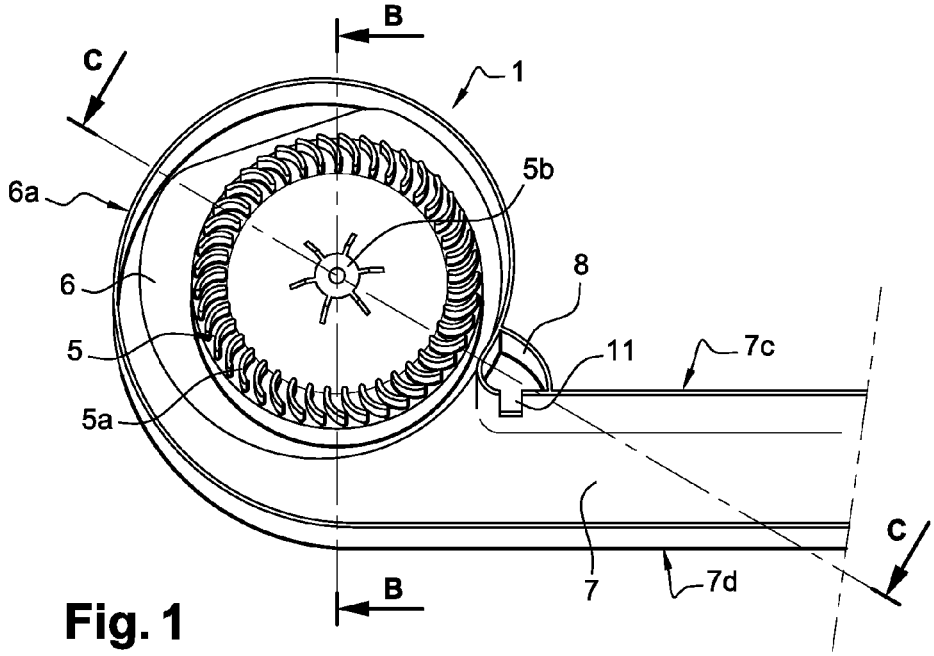
Fig. 1 Prior Art
Figure 1B:
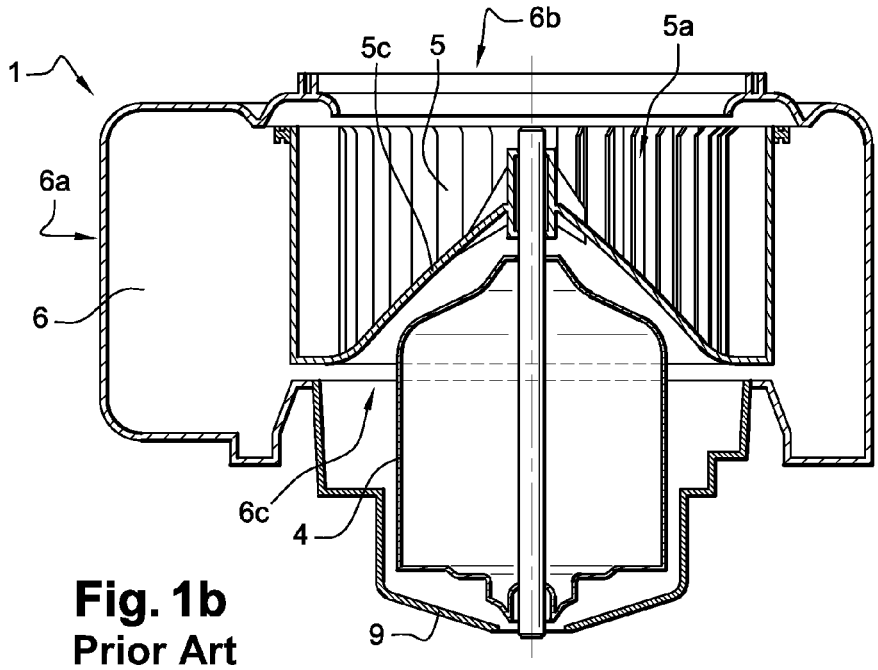
Fig. 1b Prior Art
Figure 1C:
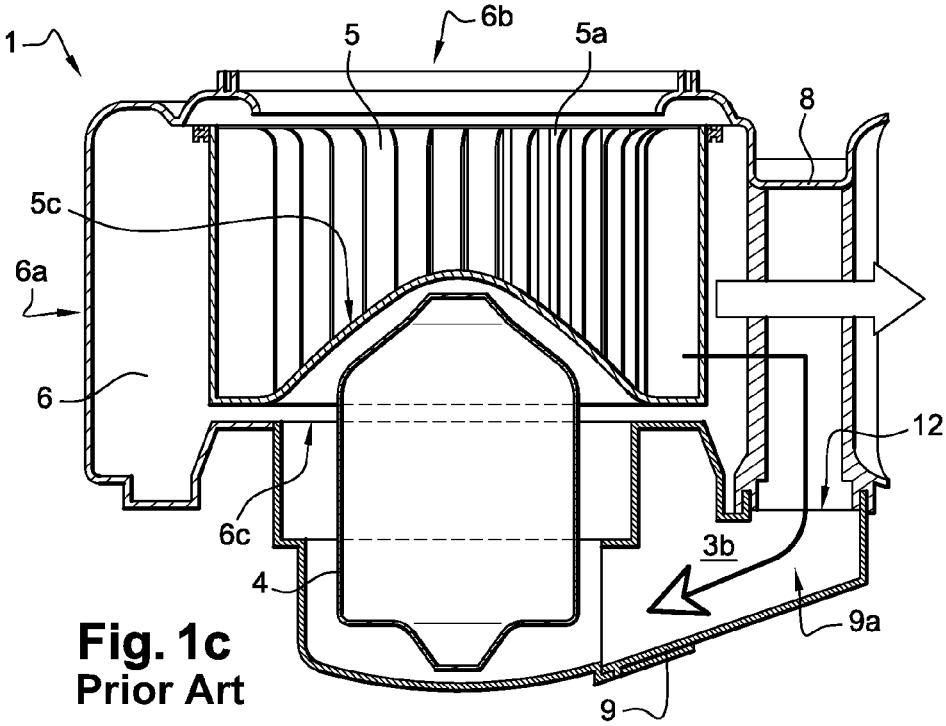
Fig. 1c Prior Art

To ventilate, and to deliver hot or cold air into, the cabin of a motor vehicle, a ventilation device is connected to an air conditioning and/or heating system to supply air to the motor vehicle cabin. As illustrated in FIGS. 1, 1*b*, and 1*c*, the ventilation device 1 comprises a casing 6, an electric motor 4, and a blower impeller 5, the latter having vanes 5*a* and a hub 5*b* and being driven by this motor. The casing 6, which is usually shaped like a spiral cylinder, comprises a peripheral wall 6*a* and two open ends 6*b*, 6*c*, the first open end 6*b* acting as the air inlet of the ventilation device 1 and the second open end 6*c* allowing the blower impeller 5 to be inserted into the internal volume of the casing 6. Also, this casing 6 defines a main air channel 7 carrying the air flow produced by the blower impeller to the air-conditioning and/or heating system. This blower impeller is connected to the electric motor 4 and is therefore held in the casing 6 by an attachment, in the second opening 6*c*, of a motor cradle 9 casing the electric motor 4. In this way, part of said motor housed in the bowl 5*c* of the impeller 5 is inside the casing 6, while the other part of the motor 4 is inside the motor cradle 9. The blower impeller 5 is driven by the electric motor 4, so that this air flow is produced by the operation of said motor. Thus, whenever the air conditioning and/or heating system is on, the electric motor 4 is running and generating heat. It is therefore vital to cool this motor to prevent it being damaged by prolonged use of the air conditioning and/or heating system.

To cool the electric motor when it is running, one approach has been to divert some of the air flow generated by the blower impeller for the air conditioning and/or heating system, so that the motor is cooled by an air flow over it. To divert some of the air flow, a secondary channel 8 is added. This secondary channel 8 comprises an air flow inlet 11 and an air flow outlet 12. The air flow inlet 11 is located in a side wall 7*c* of the main channel 7. The air flow outlet 12 corresponds to the air flow inlet of a duct 9*a* formed in the motor cradle 9. This duct is also shaped in such a way that it takes the air flow coming from the secondary channel and conveys it to the electric motor.

However, this method of cooling the electric motor has one great drawback in that the diverted air flow may be damp. This dampness may be due to weather conditions (rain, humid external air) or to water being forced in, for example during pressure-washing of the engine compartment or when the vehicle's bodywork is being washed. On these occasions, water may get into the ventilation device through its air inlet. The electric motor may therefore come into contact with water, exposing it to a serious risk of damage.

Since manufacturers' standards are becoming more and more demanding in the automotive field, for reasons of safety and durability, it is desirable to reduce the presence of water in the air flow used to cool the electric motor.

The problem is therefore how to reduce the amount of water transported by the air flow through the secondary channel and thus avoid having the electric motor coming into contact with a liquid or with over-humid air when it is running.

The applicant's invention solves this problem with a ventilation device comprising a casing suitable for channeling at least one air flow set up by a blower impeller, which casing defines a main air channel carrying a main air flow, and a secondary air channel designed to carry a secondary air flow to a motor in order to cool it, said secondary channel having on the one hand an inlet located in a wall of the main channel and on the other hand an outlet located in a plane containing an end of the casing through which the impeller is inserted; which device is characterized in that the secondary channel has a means designed to cause the secondary air flow to change direction at least twice as it travels along said secondary channel.

The provision of a means for diverting the air flow into the secondary channel prevents water reaching the outlet, because the various changes of direction imposed on the air flow in the secondary channel force the water droplets transported by this air flow to remain in a part of the secondary channel. The particular way in which the means is arranged prevents the water from getting as far as the motor cradle duct and damaging the motor.

In one particular embodiment, said means comprises at least one wall dividing said secondary channel into at least two sub-channels. The creation of two sub-channels makes it possible to impose a special route on the air flowing through the sub-channels. Moreover, one of the two sub-channels performs two functions—collecting water droplets transported in the air flow, and removing these collected droplets.

Advantageously, one wall of the second sub-channel doubles as the wall of the volute tongue of the casing. Sitting the second sub-channel here allows an unused region of the casing to be occupied. Placing the second sub-channel in the volute tongue therefore makes the casing easy to fabricate and cheap to produce. Further, this sub-channel is placed in this region for fluid-flow reasons, to avoid head losses.

Advantageously, the means also includes the inlet and the outlet, these being arranged at one end of the secondary channel, and it includes the wall which contains an opening between the two sub-channels, said opening being arranged at the opposite end from the end where the inlet and outlet are located. The particular arrangement of the inlet and outlet with respect to the opening makes it possible to form a baffle which will force the air flow to change direction at least twice before it reaches the outlet. This baffle thus prevents water reaching the outlet.

Advantageously, the inlet of the secondary channel is defined by a rim, the opening is defined by an edge, and the rim is located at a height less than the height of the edge in relation to the total height of the secondary channel. This arrangement of the inlet relative to the opening ensures that air flowing through the secondary channel cannot travel along the sub-channel comprising the outlet without changing direction.

Advantageously, the wall forming the sub-channels and the wall of the casing containing the inlet are perpendicular to each other. The arrangement of these two walls again simplifies the production of the secondary channel.

Advantageously, the casing comprises two half-shells engaging at a parting line, at least one of which two half-shells includes, projecting from the parting line, a part whose free end at least partially defines the inlet.

Advantageously, said casing comprises two half-shells engaging at a parting line, at least one of which two half-shells includes, projecting from the parting line, a part whose free end at least partially defines the opening. This two half-shell structure makes it easy to mold the sub-channels. This means that the manufacturing cost does not have to be increased because an extra part can be inserted to form both the secondary channel and the wall dividing it into two sub-channels.

Advantageously, a heating and/or air conditioning system comprises a ventilation device that incorporates at least one of the features indicated above.

Figure 2:
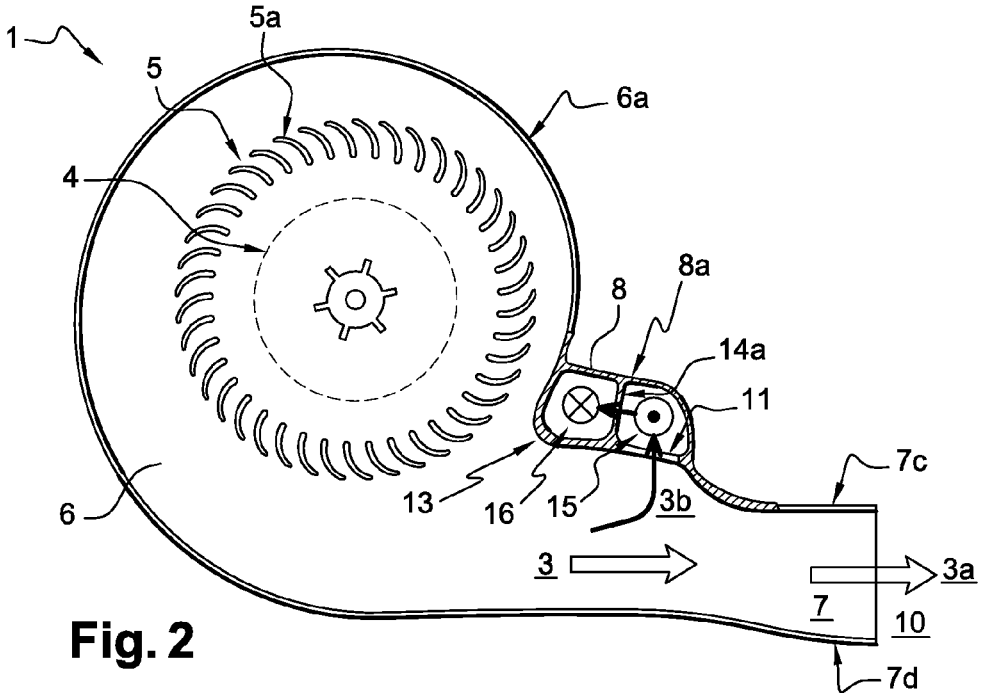
Figure 3:
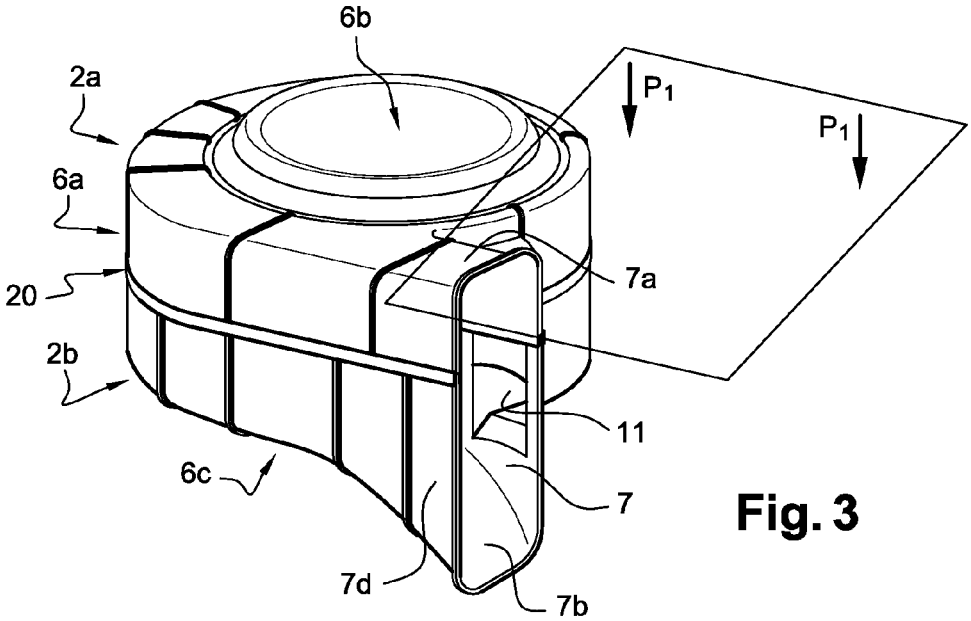
Figure 4:
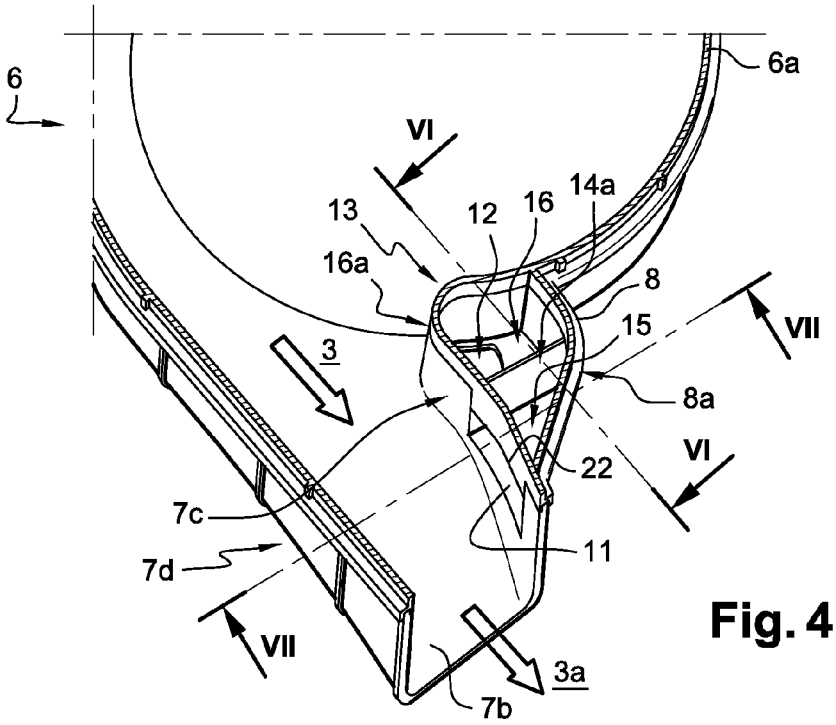
Figure 5:
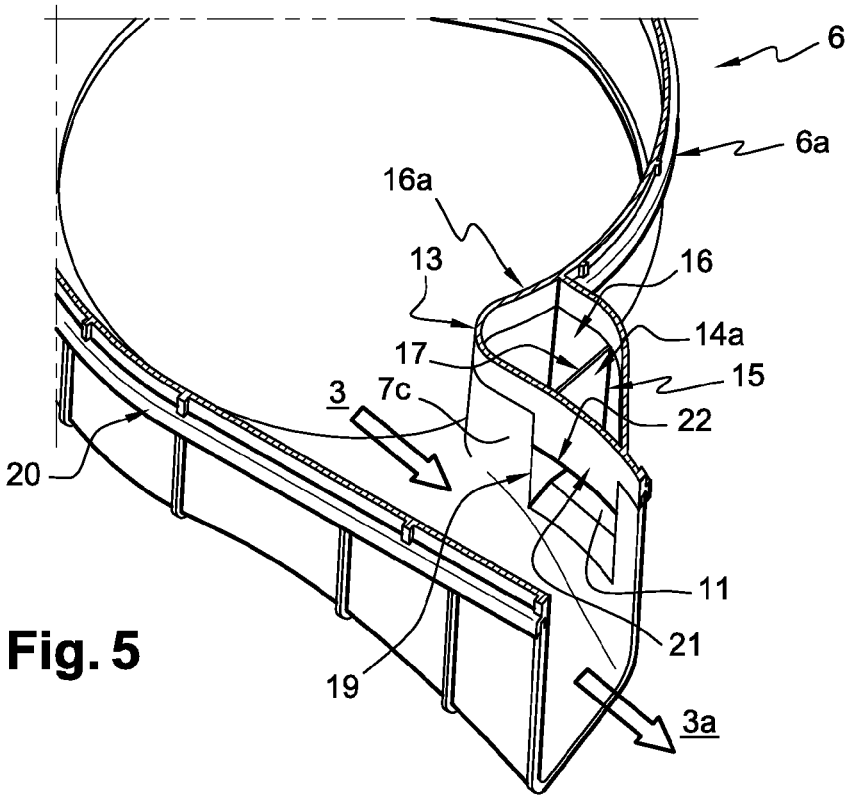
Figure 6:
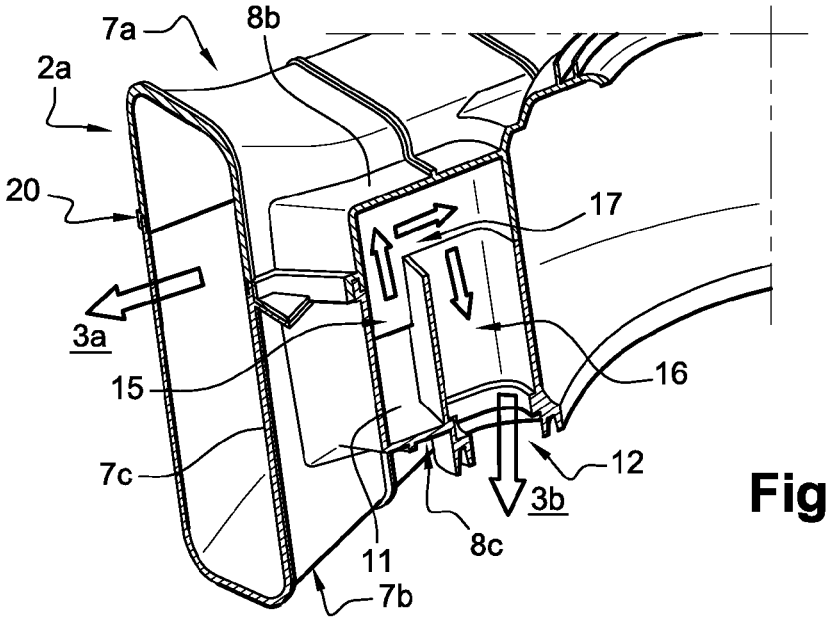
Figure 7:
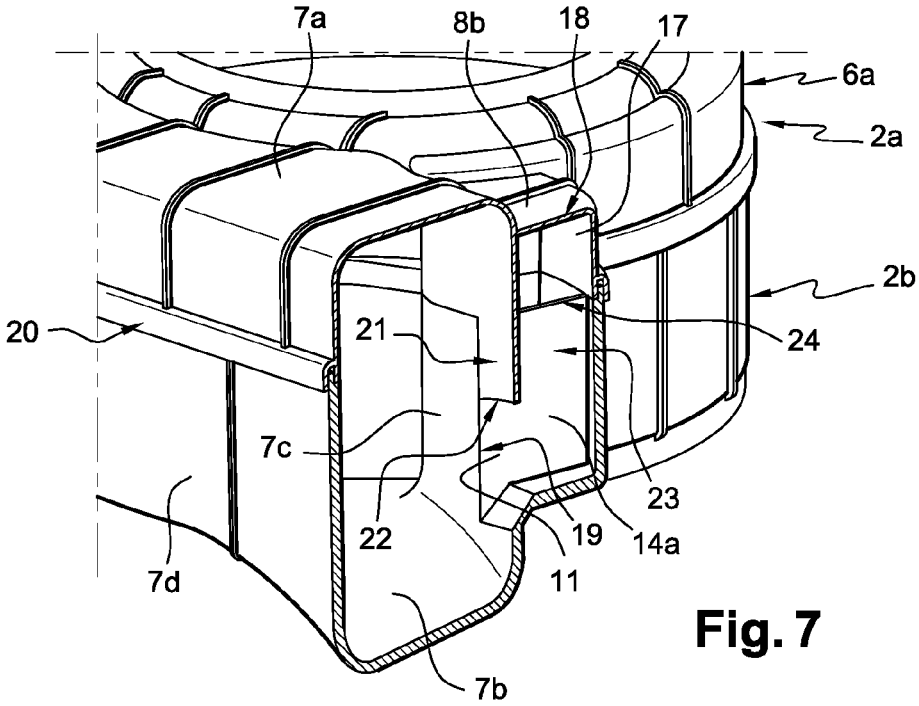
Figure 8:
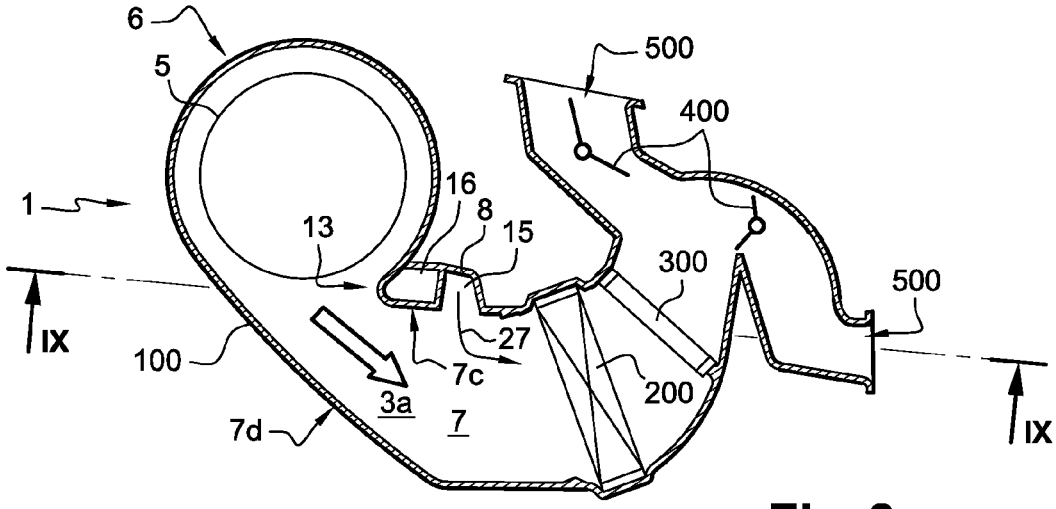
Figure 9:
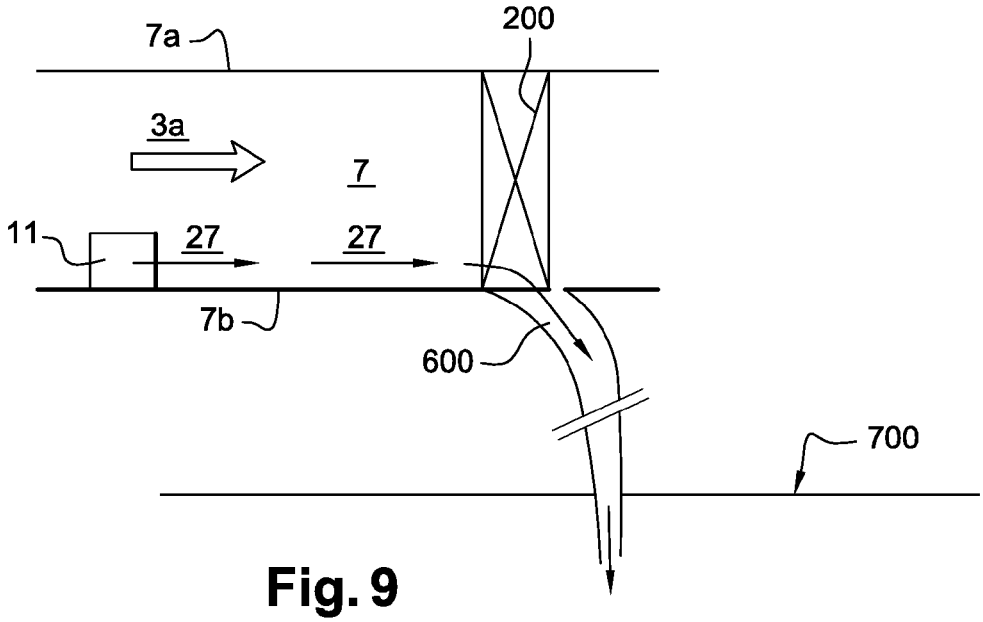
Figure 10:
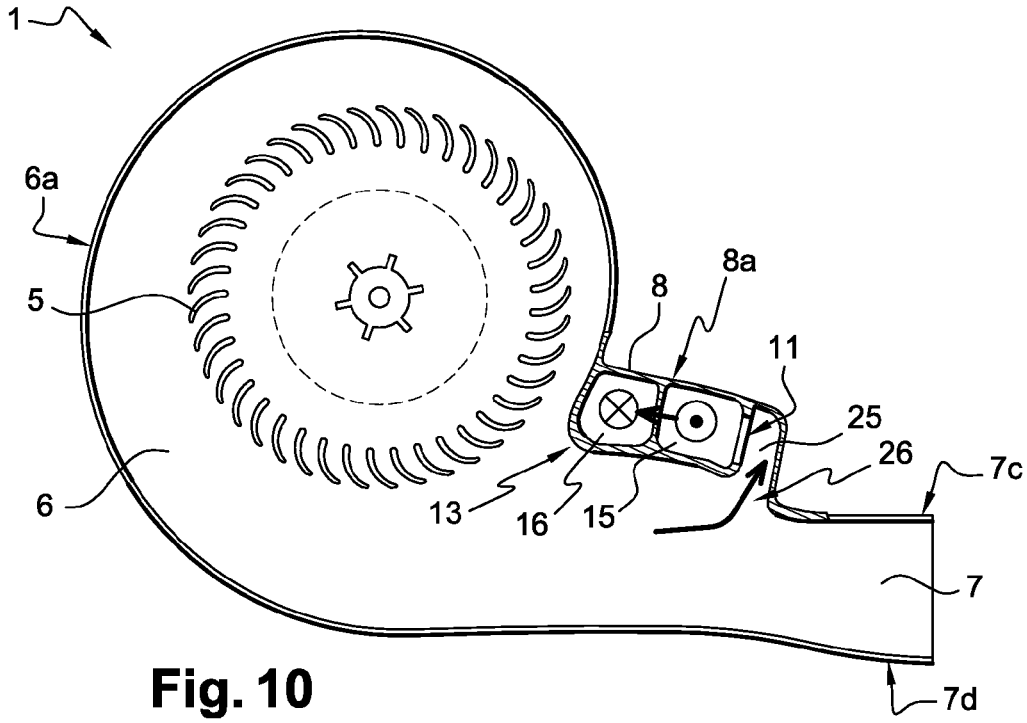

A clearer understanding of the invention and of other of its advantages will be gained from a perusal of the following description of an embodiment of the ventilation device conforming to its principle. This description is presented purely by way of example with reference to the attached drawings, in which:

FIG. 1 is a schematic view of a prior-art ventilation device for a motor vehicle, FIG. 1*b* is a schematic cross section taken on plane B as marked in FIG. 1, FIG. 1*c* is a schematic cross section taken on plane C as marked in FIG. 1, FIG. 2 is a schematic view of the invention, FIG. 3 is a perspective view of the casing 6, FIG. 4 is a cross section taken on plane P1 as marked in FIG. 3, FIG. 5 is another cross section taken on P1 as marked in FIG. 3, seen from a different angle than FIG. 4, FIG. 6 is a cross section taken on VI-VI as marked in FIG. 4, FIG. 7 is a cross section on VII-VII as marked in FIG. 4, FIG. 8 is a schematic view of an air conditioning system fitted with a ventilation device as claimed, FIG. 9 is an enlarged cross section taken on IX-IX through the part of the air conditioning system where the evaporator is located, and FIG. 10 is a cross section taken on plane P1 through another embodiment.

DESCRIPTION OF THE INVENTION

Parts that are common both to the prior art illustrated in FIGS. 1-1*c* and to the invention to which this application relates are given the same references.

FIGS. 2-7 show a ventilation device 1, itself designed to be incorporated into a ventilation/heating, ventilation/heating/air conditioning or ventilation/air conditioning appliance for a motor vehicle. FIG. 8 illustrates a ventilation/heating/air conditioning system 100 comprising the ventilation device 1 consisting of a casing 6 in the form of a volute, a blower impeller 5, and channels (7, 8, 15 and 16). The system 100 also comprises an evaporator 200 and a radiator 300 (both located in the main channel 7), distribution flaps 400, and air outlets 500 to the cabin.

A ventilation device 1 is shown in FIGS. 2 and 3. This ventilation device 1 comprises: a volute-shaped casing 6, that is, a casing defining a circular air channel whose cross section increases between a volute tongue and an air outlet; an electric motor 4; and a blower impeller 5 driven by the motor 4.

The casing 6 comprises the same parts as those of the prior art illustrated in FIGS. 1-1*c*, namely a peripheral wall 6*a*, first and second open ends 6*b*, 6*c*, and a main channel 7. This casing 6 also contains a motor 4, a blower impeller 5 with vanes 5*a*, and a motor cradle 9 similar to that shown in FIGS. 1*b* and 1*c*.

The main air channel 7 directs to an air outlet 10 of the casing 6 an air flow 3 created by the blower impeller 5 in the casing 6. This main air channel 7 is usually rectangular sectioned, but it can be square sectioned, or be cylindrical or be of any other shape in another embodiment. The main channel 7 is defined by an upper wall 7*a*, a lower wall 7*b*, and two side walls 7*c*, 7*d*. The side wall 7*c* contains an inlet 11 through which some of the air flow 3 is able to enter the secondary channel 8. The main channel 7 forms with the peripheral wall 6*a* a volute tongue 13. This volute tongue 13 is that part of the wall of the casing 6 which connects the peripheral wall 6*a* to the side wall 7*c* of the main channel 7.

As illustrated in FIGS. 2, 4, and 6, the secondary air channel 8 has a peripheral wall 8*a*, an upper wall 8*b*, a lower wall 8*c*, an inlet 11, and an outlet 12. Said secondary channel 8 is located in the volute tongue 13. More precisely, part of the peripheral wall 8*a* of the secondary channel 8 is shared with that part of the peripheral wall 6*a* of the casing 6 which forms the volute tongue 13 and with part of the side wall 7*c*. The secondary channel 8 extends transversely along the peripheral wall 6*a* of the casing 6. The outlet 12 lies in a plane P containing the end 6*c* of the casing 6 and communicates with a duct 9*a* formed into the motor cradle 9 as can be seen in FIG. 1*c*, plane P being the plane of the paper in FIG. 4. This duct allows an air flow to reach and cool the electric motor 4.

The air flow 3 produced by the blower impeller 5 travels along both the main channel 7 and the secondary channel 8. One part 3*a* of the air flow 3 flows along the main channel 7 to supply the rest of the ventilation, heating and/or air conditioning system, and another part 3*b* enters the secondary channel 8 via the inlet 11. As indicated in FIG. 1*c*, when the air flow 3*b* traveling along the secondary channel 8 passes out of the latter, it comes to the duct 9*a* of the motor cradle 9 and passes through it to cool the electric motor 4.

According to the invention, the secondary channel 8 comprises a means 14 enabling the secondary air flow 3*b* to change direction at least twice as the air flow 3*b* travels along the secondary channel 8. This means is a wall 14*a* dividing said secondary channel 8 into two sub-channels 15, 16.

As illustrated in FIGS. 4 and 5, the wall 14*a* separates the secondary channel 8 into a first sub-channel 15 and a second sub-channel 16. The first sub-channel 15 is that containing the inlet 11 and the second sub-channel 16 is that containing the outlet 12. In addition, the second sub-channel 16 shares a wall 16*a* with that wall of the volute tongue 13 of the casing 6.

As illustrated in FIGS. 5, 6, and 7, an opening 17 is provided in the wall 14*a*. The position of this opening 17 depends on the position of the inlet 11 and on that of the outlet 12. Firstly, the inlet 11 is situated at the bottom of the side wall 7*c*, i.e. in that part of the side wall 7*c* which is close to the lower wall 7*b*, and secondly, the inlet 11 and the outlet 12 are both located at the same end of the secondary channel 8 while the opening 17 is situated at the opposite end to the inlet 11 and outlet 12. In other words, the inlet 11 and the outlet 12 are formed near the lower wall 8*c* of the secondary channel and the opening 17 is formed in the wall 14*a* adjacent to the upper wall 8*b*.

Furthermore, the opening 17 is defined by an edge 18 and the inlet 11 by a rim 19. The term "edge" is used here to mean the entire perimeter of the surface forming the opening 17, and the term "rim" the entire perimeter of the surface forming the inlet 11. Hence both the edge 18 and the rim 19 consist of several sides if they are polygonal, one side if they are circular. The positioning of the opening 17 in the wall 14*a* is also relative to the position of the inlet 11 in the peripheral wall 8*a*. To cause the air flow 3*b* in the secondary channel 8 to change direction, the rim 19 of the inlet 11 is located at a height less than the height of the edge 18 of the opening 17 in relation to the total height—the height of the peripheral wall 8*a* —of the secondary channel 8. In other words, the edge 18 and the rim 19 are located with respect to each other in such a way that the air flow 3*b* that has just entered the first sub-channel 15 through the inlet 11 cannot pass into the second sub-channel 16 via the opening 17 without changing direction.

Owing to the arrangement of this opening 17, the path of the air flow 3*b* is defined by the inlet 11, the first sub-channel 15, the wall. 14*a*, the opening 17, the second sub-channel 16, and the outlet 12. Thus, this assembly (11, 15, 14*a*, 17, 16, and 12) represents a "baffle" for the air flow 3*b* and forms the means 14. This baffle allows the air flow 3*b* to dump its water droplets, which will remain in the first sub-channel 15.

As shown in FIGS. 8 and 9, water 27 collected in the first sub-channel 15 can then be drained off through the inlet 11 since the latter is at the bottom of the side wall 7*c*. Moreover, this water 27 drained off through the inlet 11 is conveyed to the evaporator 200 and finally removed from the vehicle via a condensate pipe 600 passing out of the evaporator 200 through the floor of the vehicle 700. The baffle structure therefore produces a water droplet-free air flow at the outlet 12 of the secondary channel 8 that passes through the duct of the motor cradle to cool the electric motor 4.

As explained earlier, the baffle structure of the secondary channel 8 enables the air flow 3*b* to change direction at least twice. The direction-changing air flow 3*b* is that taken from the air flow 3 through the inlet 11. The air flow 3*b* to be considered is therefore an air flow already present in the secondary channel 8 and moving in any direction inside this secondary channel 8. The location of the inlet 11 with respect to the opening 17 in the wall 14*a* thus forces this air flow 3*b* to change direction at least twice before it reaches the outlet 12 of the secondary channel 8. The expression "change direction" here refers to any change of orientation imposed on the air flow by the means 14 situated in the secondary channel 8.

As shown in FIGS. 3-7, the casing 6 is made up of two half-shells 2*a*, 2*b*. These two half-shells 2*a*, 2*b* engage at a parting line 20. At the secondary channel 8, these two half-shells slot together to form said secondary channel with its inlet 11 and its wall 14*a*. More precisely, once the casing 6 is formed, half-shell 2*a* comprises, projecting from the parting line 20, a part 21 whose free end 22 at least partially defines the inlet 11.

In an alternative, the other half-shell 2*b* comprises, projecting from the parting line 20, a part 23 whose free end 24 at least partially defines the opening 17. "Partially" here indicates the fact that the free end 22 defines one side of the rim 19, the other sides being defined by the other half-shell. Likewise "partially" indicates the fact that the end 24 defines one side of the edge 18, the other sides being defined by the other half-shell. In order to create the baffle structure, the projecting parts 21 and 23 extend in opposite directions. The general idea of the invention is to stagger the inlet 11 and the opening 17 in one direction so as to form this baffle.

In a preferred embodiment, the wall 14*a* and the side wall 7*c* containing the inlet 11 are perpendicular to each other. In this embodiment, one edge of the wall 14*a* coincides with the edge of the side wall 7*c* forming one side of the rim 19.

In another embodiment, the secondary channel 8 comprises two walls 14*a*. The general idea of the invention being to form one or more baffles to divert the air flow traveling through said secondary channel 8, a second opening 17' in a second wall 14*a'* is provided at the same end of the secondary channel 8 as the inlet 11. This means that the outlet 12 will be situated at the same end of the secondary channel 8 as the first opening 17.

In general terms, where the invention comprises more than one wall 14*a*, each opening 17, 17', 17", 17'", etc., is dependent on the position of the preceding opening with respect to the movement of the air flow in the secondary channel 8, in order to form the baffle structure. Of course, the first opening 17 after the inlet 11 will always be located as in the first embodiment. Also, the position of the outlet 12 may change, i.e. it may either be in the lower wall 8*c*, or be at the top of the peripheral wall 8*a*, depending on how many walls 14*a* there are in the secondary channel 8.

Concerning the rim 19 of the inlet 11 and the edge 18 of the opening 17, their arrangement in the secondary channel 8 must also conform with the need to form a baffle for the air flow 3*b*. Since the inlet 11 and the first opening 17 do not change position, the rim 19 and the edge 18 are at different heights as already described in this application. The edge 18' of the second opening 17' must be at a height less than the height of the edge 18 of the first opening 17 in relation to the total height of the secondary channel 8. In the same way, the n-th edge 18 of the n-th opening 17 must be at a height greater or less than the height of the (n-1)th edge of the (n-1)th opening 17 in order to form a baffle for the air flow 3*b*. Lastly, the outlet 12 must be positioned so as to respect the baffle structure in relation to the number of walls 14*a* (and therefore of openings 17) present in the secondary channel 8.

In a variant of the previous embodiment, the inlet 11 to the secondary channel 8 is situated in a-cavity.25. As shown in FIG. 10, the cavity 25 is defined by the side wall 7*c* of the main channel 7 and is U-shaped. This cavity 25 communicates with the main channel 7 via an opening 26. This opening 26 has a height equal to the height of the main channel 7, i.e. the opening 26 extends transversely all the way up the side wall 7*c*. The location of this cavity 25 allows that part of the air flow 3*b* which is to pass along the secondary channel 8 to first enter the cavity 25 and then move into the secondary channel 8 through the inlet 11. In this embodiment, the secondary channel 8 is located in the volute tongue 13 as described earlier. The inlet 11 of the secondary channel 8 is situated in the U-shaped part of the side wall 7*c*. Moreover, the inlet 11 is situated in that part of the side wall 7*c* which is near the lower wall 7*b* as described previously. The inlet 11 is thus accessible to the air flow only via the cavity 25.

The invention claimed is:

1. A ventilation device (1) comprising:

a casing (6) suitable for channeling at least one air flow (3) set up by a blower impeller (5), with said casing (6) defining;

a main air channel (7) carrying a main air flow (3*a*), a secondary air channel (8) designed to carry a secondary air flow (3*b*) to a motor (4) having a shaft in order to cool said motor (4), an opening defined by an end of said casing (6) through which the impeller (5) is inserted into said casing (6), and a volute tongue (13) defined by at least a portion of a peripheral wall (6*a*) of said casing (6), a portion of a side wall (7*c*) of said main channel (7), and a periphery wall (8*a*) of said secondary channel (8);

wherein said secondary channel (8) is located in said volute tongue (13) and having on the one hand an inlet (11) located in said portion of said wall (7*c*) and on the other hand an outlet (12) with an opening of said outlet (12) and said opening defined by said end of said casing (6) entirely located in a common plane that is perpendicular to said shaft of said motor (4); and wherein said secondary channel (8) has a means (14) designed to cause the secondary air flow (3*b*) to change direction at least twice as it travels along said secondary channel (8).

2. A ventilation device according to claim 1, wherein said means (14) comprises at least one wall (14*a*) dividing said secondary channel (8) into at least two subchannels (15, 16).

3. A ventilation device according to claim 2, wherein one wall (16*a*) of said sub-channel (16) doubles as a wall of said volute tongue (13) of said casing (6).

4. A ventilation device according to claim 3, wherein said means (14) also includes said inlet (11) and said outlet (12), said inlet (11) and said outlet (12) being arranged at one end of said secondary channel (8), and in that it includes said wall (14*a*) which contains an opening (17) between said two sub-channels (15, 16), said opening (17) being arranged at an opposite end from an end where said inlet (11) and said outlet (12) are located.

5. A ventilation device according to claim 4, wherein said inlet (11) of said secondary channel (8) is defined by a rim (19), said opening (17) is defined by an edge (18), and in that said rim (19) is located at a height less than a height of said edge (18) in relation to a total height of said secondary channel (8).

6. A ventilation device according to claim 2, wherein said wall (14*a*) and said wall (7*c*) of said casing (6) containing said inlet (11) are perpendicular to each other.

7. A ventilation device according to claim 1, wherein said casing (6) comprises two half-shells (2*a*, 2*b*) engaging at a parting line (20), at least one of said two half-shells (2*a*, 2*b*) includes, projecting from said parting line (20), a part (21) whose free end at least partially defines said inlet (11).

8. A ventilation device according to claim 4, wherein said casing (6) comprises two half-shells (2*a*, 2*b*) engaging at a parting line (20), at least one of said two half-shells (2*a*, 2*b*) includes, projecting from said parting line (20), a part (23) whose free end at least partially defines said opening (17).

9. A heating and/or air conditioning system comprising a ventilation device (1) according to claim 1.

10. A ventilation device according to claim 3, wherein said wall (14*a*) and wall (7*c*) of said casing (6) containing said inlet (11) are perpendicular to each other.

11. A ventilation device according to claim 4, wherein said wall (14*a*) and said wall (7*c*) of said casing (6) containing said inlet (11) are perpendicular to each other.

12. A ventilation device according to claim 5, wherein said wall (14*a*) and said wall (7*c*) of said casing (6) containing said inlet (11) are perpendicular to each other.

13. A ventilation device according to claim 4, wherein said casing (6) comprises two half-shells (2*a*, 2*b*) engaging at a parting line (20), at least one of said two half-shells (2*a*, 2*b*) includes, projecting from said parting line (20), a part (21) whose free end at least partially defines said inlet (11).

14. A ventilation device according to claim 5, wherein said casing (6) comprises two half-shells (2*a*, 2*b*) engaging at a parting line (20), at least one of said two half-shells (2*a*, 2*b*) includes, projecting from said parting line (20), a part (21) whose free end at least partially defines said inlet (11).

15. A ventilation device according to claim 6, wherein said casing (6) comprises, two half-shells (2*a*, 2*b*) engaging at a parting line (20), at least one of said two half-shells (2*a*, 2*b*) includes, projecting from said parting line (20), a part (21) whose free end at least partially defines said inlet (11).

16. A ventilation device according to claim 6, wherein said casing (6) comprises two half-shells (2*a*, 2*b*) engaging at a parting line (20), at least one of said two half-shells (2*a*, 2*b*) includes, projecting from said parting line (20), a part (23) whose free end at least partially defines said opening (17).

17. A ventilation device according to claim 7, wherein said casing (6) comprises two half-shells (2*a*, 2*b*) engaging at a parting line (20), at least one of said two half-shells (2*a*, 2*b*) includes, projecting from said parting line (20), a part (23) whose free end at least partially defines said opening (17).

18. A heating and/or air conditioning system comprising a ventilation device (1) according to claim 4.

19. A heating and/or air conditioning system comprising a ventilation device (1) according to claim 7.

20. A heating and/or air conditioning system comprising a ventilation device (1) according to claim 8.

* * * * *

UNITED STATES PATENT AND TRADEMARK OFFICE

CERTIFICATE OF CORRECTION

PATENT NO. : 8,439,655 B2
APPLICATION NO. : 11/732527
DATED : May 14, 2013
INVENTOR(S) : Pouysegur It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1357 days.

Signed and Sealed this
Sixteenth Day of December, 2014

Michelle K. Lee

Michelle K. Lee
*Deputy Director of the United States Patent and Trademark Office*